United States Patent [19]

Mingot

[11] 4,145,154

[45] Mar. 20, 1979

[54] NON-SKID HIGHWAY SURFACING

[75] Inventor: Claude M. Mingot, Ners-St-Chaptes, France

[73] Assignee: Agence Nationale de Valorisation de la Recherche (ANVAR), Neuilly-sur-Seine, France

[21] Appl. No.: 764,660

[22] Filed: Feb. 1, 1977

[30] Foreign Application Priority Data

Feb. 13, 1976 [FR] France ..... 76 04668

[51] Int. Cl.[2] ..... E01C 19/00

[52] U.S. Cl. ..... 404/81; 404/108

[58] Field of Search ..... 404/17, 20, 108, 91, 404/82, 81, 72, 75

[56] References Cited

U.S. PATENT DOCUMENTS

| | | | |
|---|---|---|---|
| 984,801 | 2/1911 | Davis | 404/81 |
| 2,068,702 | 1/1937 | Poulson | 404/82 |
| 2,147,195 | 2/1939 | Finley | 404/82 X |
| 2,201,493 | 5/1940 | Jorgensen | 404/92 |
| 2,783,698 | 3/1957 | Bambi | 404/91 X |
| 3,396,644 | 8/1968 | Banks | 404/108 X |
| 3,400,644 | 9/1968 | Baskin | 404/20 |
| 3,699,855 | 10/1972 | Leister | 404/108 X |
| 3,868,262 | 2/1975 | Ohlson | 404/81 |
| 3,901,615 | 8/1975 | Ceintrey | 404/20 |
| 4,011,023 | 3/1977 | Cutler | 404/91 |

*Primary Examiner*—Nile C. Byers, Jr.
*Attorney, Agent, or Firm*—Lewis H. Eslinger

[57] ABSTRACT

A process of making and spreading, on a highway, a non-skid highway surfacing composed of aggregates mixed in a bituminous binder, according to which aggregates mixed in molten asphaltic bitumen are prepared, which are screened at the same time as they are spread, with the result that a relatively thick surfacing carpet is obtained which is composed of two superposed layers, the top layer of which is constituted by the chips retained by the screen.

9 Claims, 4 Drawing Figures

NON-SKID HIGHWAY SURFACING

The present invention relates to a process of making a non-skid highway surfacing, a finishing machine for spreading this surfacing and the surfacing thus obtained.

Known highway surfacings belong to two main categories.

A first category is that of single-surface or multiple-surface dressings which are thin coatings having a thickness of between 10 mm and 20 mm, obtained by successively spreading onto the highway one or more films of a liquid binder, generally a bituminous binder, on each of which are spread one or more successive layers of chips of different grading or granularity, for example 4/6 mm, 6/10 mm or 10/14 mm chips. The chips may be previously coated with asphaltic bitumen or any other binder.

The surface dressings are clearly less expensive per surface unit than asphaltic concrete carpets and their roughness is good. On the other hand, they do not enable a highway to be levelled. The binder collects at low points hence the risk of bleeding at these spots and throwing out of chips at high points where there is a lack of binder. Due to their small thickness, the dressings wear out rapidly and they are not well suited to roads with heavy traffic such as motorways.

A second category of surface dressings is that of asphaltic concrete chips or so-called bituminous mix carpets which are composed of one or more superposed layers of aggregates previously mixed in molten asphaltic bitumen, which layers are successively spread in the form of a carpet by means of so-called finishing machines at a temperature of between 130° and 170°. Each layer may be between 4 cm and 10 cm thick.

Asphaltic concrete carpets enable a highway to be levelled but their cost per surface unit is between 5 and 20 times greater than that of the surface dressings.

Moreover, the surface of a bituminous mix carpet does not remain rough indefinitely and it must be renewed even before it is worn, this creating serious drawbacks, particularly on high-volume roads such as motorways where relatively thick carpets are used, which must be renewed fairly frequently with the result that the thickness of the highway increases and in the long run the height beneath bridges and other highway structures is reduced, this presenting a serious problem.

Whatever the type of surfacing, one of the essential qualities thereof is its roughness which determines the slipperiness of the highway and the safety of the vehicles.

The slipperiness depends on numerous factors, including the nature of the aggregates and their resistance to polishing, the geometrical arrangement, the size and shape of the surface particles, the quantity of binder, the nature and profile of the support, etc . . .

To obtain virtually non-slip highways, the following conditions must be fulfilled simultaneously:

Hard aggregates must be used, having sufficiently large particles, disposed according to a regular mosaic, without gaps, avoiding long or flat particles.

The binder must be well proportioned and the binder content must vary inversely with respect to the content of the highway to be renewed. If one or more of these conditions are not complied with, there is a risk of slippery areas appearing.

To increase ground grip of the tyres, thin surfacings may be made with fine particles which increase the contact surface between the tyres and the highway. However, if the particles are too fine, they risk being drowned in the puddles, this leading to the phenomenon of "aquaplaning" which may lead to accidents.

To contend with this phenomenon, surfacings have been used which comprise larger chips but the contact surface between the tyres and the surfacing is then limited to the tops of the particles of the top layer. These will gradually wear and become smooth and rounded, and the highway becomes slippery again.

Attempts have also been made to improve the roughness of the highways by scratching or granulating the surfacing but these solutions lead to a defective appearance thereof, projections of chips and an increase in cost prices without offering a satisfactory solution.

It is an object of the present invention to provide a novel non-skid highway surfacing intermediate between a double-surface dressing and an asphaltic concrete.

A process of making a non-skid highway surfacing according to the invention comprises the following steps of:

previously making, in a mixing plant, hot-mixed aggregates by melting a bituminous binder, heating chips and sand and mixing the hot chips and sand and the molten binder, then spreading a relatively thick layer of these mixed aggregates onto the highway.

The object of the invention is attained by a process according to which the hot-mixed aggregates are screened, at the same time as they are spread, through a screen which is displaced along the highway, whose mesh is smaller than the dimension of the largest chips and the material retained thereby drops off at the end of the screen opposite the direction of displacement.

The mesh of the screen is preferably such that the quantity of aggregates retained on the screen then poured onto the highway, expressed in liters per square meter of highway, is substantially equal to the upper limit of grading of the chips expressed in millimeters.

The invention results in a novel non-skid highway surfacing constituted by a relatively thick carpet of hot-mixed aggregates, which comprises two superposed layers of mixed aggregates, of different grading, which were spread out simultaneously by screening the mixed aggregates at the same time as spreading them out, with the result that the top layer which is constituted by the material retained by the screen is composed of a continuous mosaic of large chips which penetrate into the lower layer.

The aggregates of a highway surfacing according to the invention comprise chips whose grading is preferably included on the one hand in a first range of between 9 and 16 mm and on the other hand in a second smaller range presenting a discontinuity with respect to the first range and these previously mixed aggregates are spread, hot, through a screen whose mesh is smaller than the upper limit of the first range of grading.

This discontinuity in the grading of the chips, which is at least 2 mm, facilitates the screening of the mixes and enables a top layer to be obtained which is constituted by the material retained by the screen and which is composed solely of uniform particles which are clearly larger than the particles of the lower layer.

A highway surfacing according to the invention is composed of aggregates mixed in asphaltic bitumen, in a proportion equal to about 5% of the total weight, which aggregates are preferably composed:

of a first type of chips graded between 9 mm and 16 mm and preferably between 10 mm and 14 mm, constituting between 30% and 50% of the total weight, of a second type of chips, graded between 2 mm and 6 mm, constituting between 10% and 30% of the total weight, of sand graded between 0 and 4 mm, constituting between 30% and 50% of the total weight and of a filler constituting between 1% and 5% of the total weight.

The sand is preferably graded in a range having a discontinuity of at least 1 mm with respect to the grading of the second type of chips.

The present invention also relates to a finishing machine for spending a carpet of non-skid surfacing on a highway.

Known finishing machines comprise a vehicle provided, from front to rear, with:

a hopper for receiving hot-mixed aggregates coming from a mixing plant, a longitudinal conveyor located beneath said hopper and which empties the material carried thereon at its rear end, a vibrating beam, a smoothing screed.

A finishing machine according to the invention further comprises a rearwardly inclined vibrating screen onto which said conveyor empties, the mesh of said screen being smaller than the upper limit of grading of the chips.

The rear edge of the screen is preferably fixed to the vibrating beam.

The screen advantageously comprises substantially longitudinal, vertical partitions for distributing the aggregates.

Where the mixed aggregates comprise two ranges of grading separated by a discontinuity, the mesh of the screen is larger than the upper limit of the lower grading range and smaller than the upper limit of the high grading range and it is preferably larger than the lower limit of the high grading range.

A non-skid highway surfacing according to the invention is intermediate between the carpets of bituminous mixes and the single-or multiple-surface dressings.

It is like bituminous mixes or asphaltic concrete in that it is composed of mixed aggregates which are spread, hot, to form a relatively thick carpet (between 3 and 10 cm) which enables the highway to be levelled.

It is like double-surface dressings in that the aggregates are separated into two layers by screening, with the result that the surface layer is composed solely of larger particles of substantially uniform size for example of 12.5/14 mm particles if a 12.5 mm screen is used.

This structure of the top layer gives it a good roughness and the surfacing has good non-skid properties which were able to be tested in the laboratory.

Unlike the double-surface dressings, the two layers are laid simultaneously with the result that the particles of the top layer are enchased in the mass of the lower layer and there is no risk of their being torn out.

Moreover, the particles of the top layer are coated with a film of bitumen powdered with paticles of sand, this giving them a microrugosity.

Despite resemblances with a bituminous mix, the surfacings according to the invention are not bituminous mixes and must therefore not be tested as such.

The life of the surfacings according to the invention is comparable to that of a high performance surface dressing since the surface layer is formed of particles which do not penetrate into the support and which are not thrown out and it therefore remains rough for a long time.

The non-skid properties of a surfacing according to the invention are therefore better than those of a bituminous mix.

The surfacings according to the invention have the following advantages:

They are relatively inexpensive, their cost per surface unit being in the bottom third of the price range of known surfacings.

They are simple to make with the aid of already existing equipment for preparing and spreading bituminous mixes. Although the choice of the aggregates is different, the mixing remains the same and the spreading is effected with the same, slightly modified, finishing machines.

The proportion of asphaltic bitumen with respect to the weight of aggregate is smaller than for the surface dressings and the binder is better distributed in the mass due to the mixing, this eliminating any risk of bleeding and local accumulation of binder.

Their thickness is included between 3 and 10 cm which is sufficient to allow levelling.

They are virtually insensitive to bad weather during and after spreading.

Their roughness is superior to that of known surfacings.

The invention will be more readily understood on reading the following description with reference to the accompanying drawings, in which.

Figure 1:
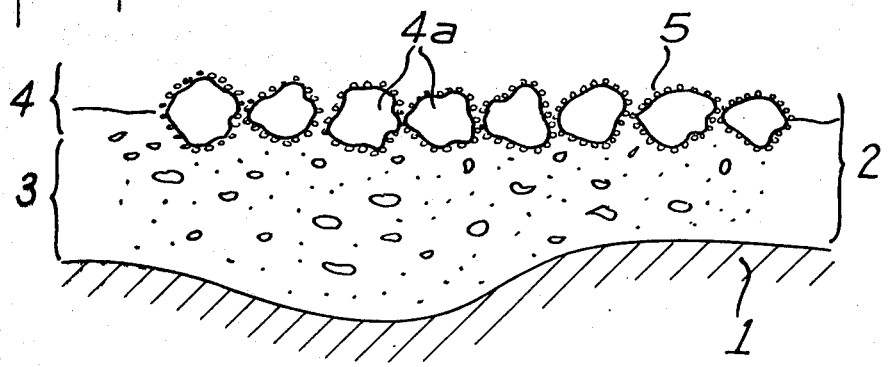
FIG. 1 is a vertical section through a portion of highway having a surfacing according to the invention.

Referring now to the drawings, FIG. 1 shows at 1 the highway to be renewed and at 2 a surfacing according to the invention. This surfacing is composed of a lower layer 3 formed of mixed aggregates graded for example between 0 and 6 mm and of a top layer 4 formed of chips 4*a* mixed with asphaltic bitumen and graded for example between 12.5 and 14 mm.

The film of asphaltic bitumen which coats each particle is powdered with sand particles 5.

The top layer has both a macrorugosity due to the particles 4*a* and a microrugosity due to the grains of sand 5 adhering thereto.

The layers 3 and 4 are laid simultaneously by screening, with the result that the particles 4*a* are solidly enchased in the lower layer and in one another thus forming a continuous and regular mosaic which resists tearing out in the manner of a paving formed of blocks carefully bonded with one another.

A preferred composition of the aggregates constituting the surfacing 2 is as follows:

| | |
|---|---|
| - chips 10/14 | 40% |
| - chips 2/6 | 20% |
| - crushed or ground quartz sand 0–0.5 charged to 20% minimum | 40% |

-continued

| | |
|---|---|
| - fat or hydraulic lime serving as filler | 2% |
| - asphaltic bitumen 40/50 | 5.5% |

It will be noted that the chips belong to two classes of grading separated by a large discontinuity of 4 mm. These classes of grading may vary but according to an important feature of the invention, a discontinuity of at least 2 mm must be maintained between them, this facilitating the screening of the aggregates and the separation into two layers of clearly different grading or granularity.

Similarly, it is preferable to use a sand having a discontinuity with the grading of the smallest chips. This sand must contain a large proportion of natural filler, i.e. of particles smaller than 80μ, which give the lower layer a high angle of friction, intended to resist the penetration of the particles 4a into the lower layer.

The sand used will preferably be a crushed quartz sand which exists abundantly as residue from the treatment of metalliferous ores contained in a gangue of quartz.

The use of such a quartz sand enables an inexpensive by-product to be used and thus a polluting waste product to be eliminated.

The first phase of making a surfacing according to the invention is the proportioning, mixing and coating of the aggregates. These operations are carried out in a known mixing plant containing proportioning devices which guarantee that the production is in accordance with the regulations in force.

The laying of the surfacing carpet is carried out by means of any known finishing machine which has been improved to be adapted to obtain a surfacing according to the invention.

Figure 2:
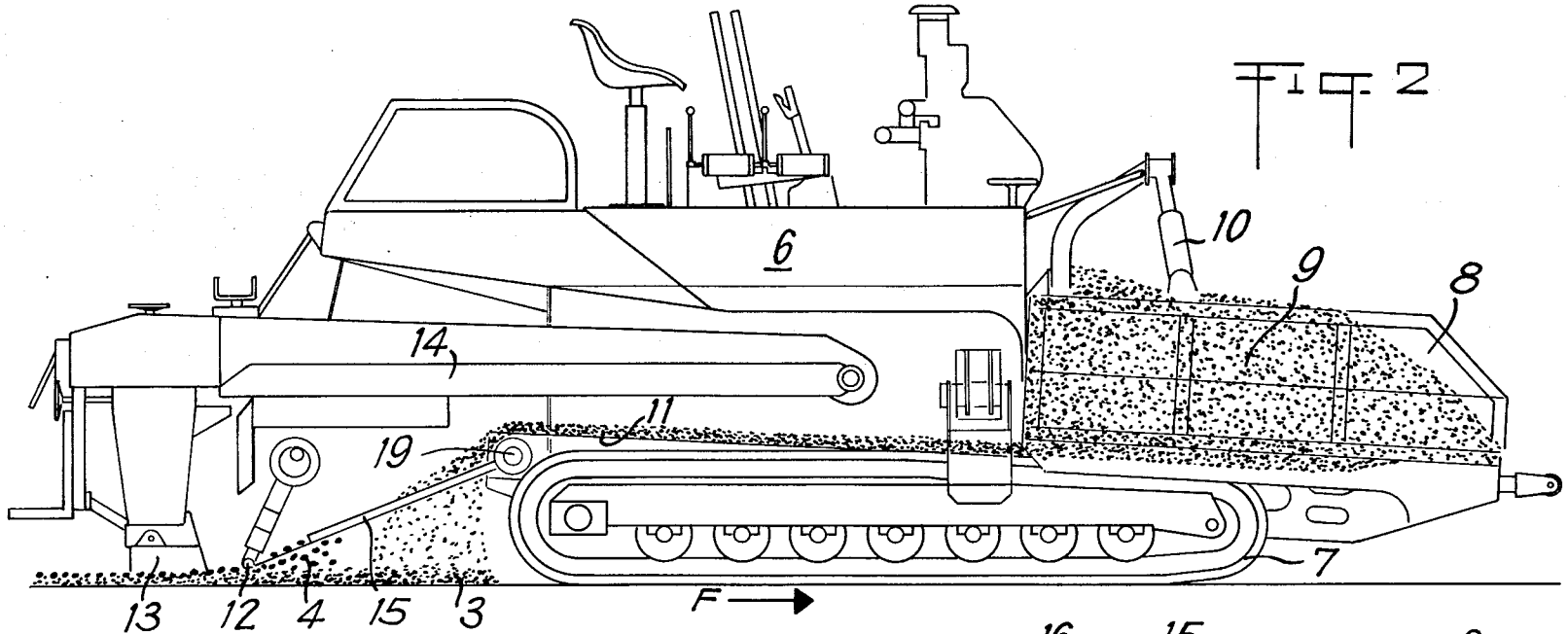
FIG. 2 is a longitudinal section through a finishing machine according to the invention.
Figure 3:
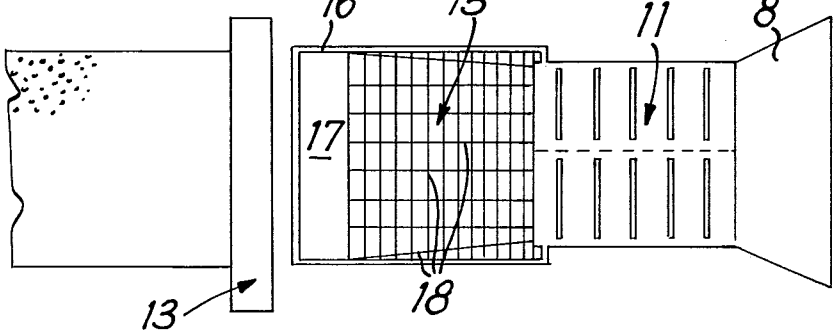
FIG. 3 is a plan view of the machine of FIG. 2.

FIGS. 2 and 3 schematically show, by way of example, a finishing machine of known type adapted according to the invention.

The finishing machine 6 is a self-propelled vehicle mounted on endless tracks 7 or wheels, or a towed vehicle.

At the front, it comprises a hopper 8 into which are poured the mixed aggregates 9 arriving for example through spouts 10.

The finishing machine comprises a longitudinal conveyor 11, partly located beneath the hopper 8, which is of any known type, such as band conveyor, chain conveyor, drag conveyor, etc . . . The contents of this conveyor drop off at the rear end.

To the rear of the conveyor, there is generally provided a transverse worm which uniformly distributes the material over the whole length of the conveyor, but this has been eliminated. Further to the rear, the finishing machine comprises a transverse vibrating beam 12 and a smoothing screed 13 which levels and rams the carpet. The smoothing screed 13 and the vibrating beam 12 are carried by pivoting arms 14 which lift them when the spreading operation is terminated.

Arrow F indicates the direction of movement, during the spreading of the carpet.

The finishing machine according to the invention further comprises a screen 15 placed immediately behind the rear end of the conveyor 11 onto which the material on said conveyor drops.

The mesh of the screen is obviously smaller than the largest size of the largest chips and it is larger than the size of the largest intermediate chips, i.e. than the lower limit of the discontinuity. In the case of the preferred composition indicated hereinabove, the mesh of the screen is for example 12 mm, i.e. located in the range 10/14 corresponding to the largest grade.

The fraction lower than the mesh of the screen, composed mainly of the sand and 0/6 chips below the discontinuity, passes through the screen to constitute the lower layer 3. The material retained by the screen, composed of 12.5–14 mm chips drops off the screen at its end, onto the layer 3 and forms layer 4. The two layers 3 and 4 are therefore laid virtually simultaneously in one operation, hence there is a very good cohesion between these two layers.

The mesh of the screen varies with the grading of the chips. According to a feature of the invention, a screen is used such that the quantity retained thereon then spread on the highway, expressed in liters per $m^2$ of highway, is substantially equal to the upper limit of grading of the largest chips expressed in millimeters.

A vibrating screen 15 is preferably used, in order to improve screening.

According to a further feature of the invention, the rear end of the support 16 of the screen is carried by the vibrating beam 12, with the result that the mechanism for vibrating the beam vibrates the screen at the same time. A gap 17 is made between the rear edge of the screen 15 and the vibrating beam to allow the material retained by the screen to drop through.

Figure 4:
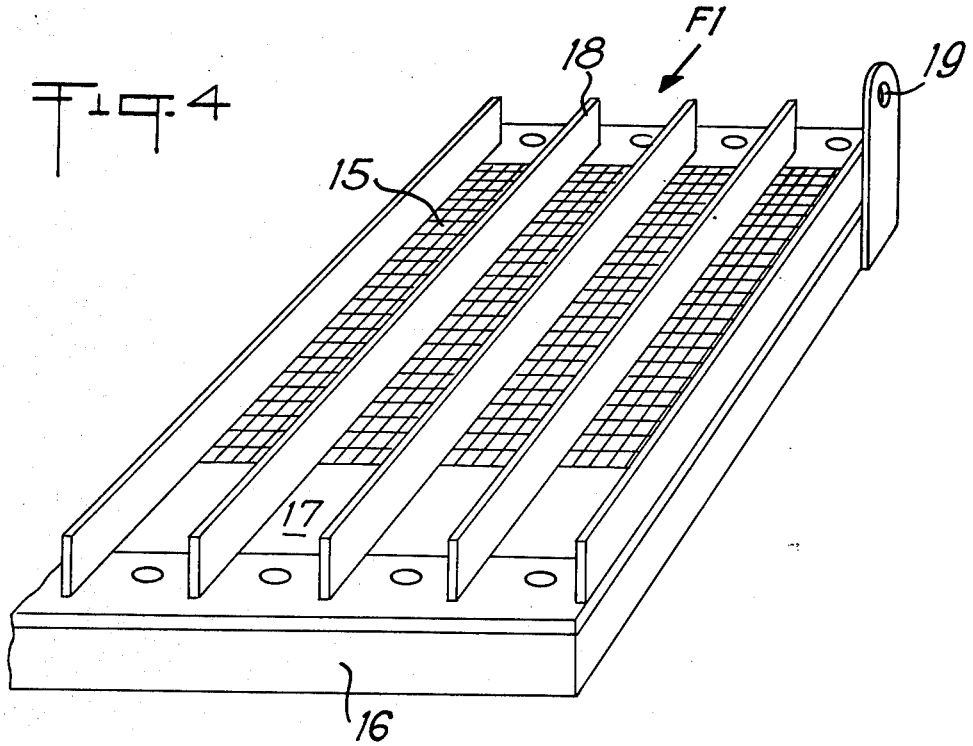
FIG. 4 is a perspective view of a screen with which a finishing machine according to FIGS. 2 and 3 is provided.

The screen 15 preferably comprises substantially longitudinal, vertical partitions 18 which may be more clearly seen in FIG. 4, whose function is to obtain a uniform distribution of the material over the whole width of the screen. The grid of the screen 15 may be heated, if climatic conditions necessitate this, in order to avoid the binder setting and to facilitate screening.

Most finishing machines comprise a means for heating the smoothing screed which is either electric or composed of fuel-oil burners. In this case, this means is also used for heating the grid of the screen, for example by providing the device with one or more fuel-oil burners whose flame is directed towards the grid.

The front edge of the screen support is pivoted about a horizontal transverse pin 19 so that the inclination of the screen may be easily modified and it may be lifted once the spreading operation has terminated, during displacements between sites.

FIG. 4 is a perspective view on a larger scale of part of the screen.

This Figure shows the screen 15 placed on a support frame 16, the gap 17, the distribution partitions 18 and passage 19 for the pivot pin. Arrow F1 indicates the direction of advance of the materials.

Once it is laid, the surfacing carpet is compacted by a pneumatic-tyred compactor.

The various elements constituting the surfacings and the apparatus described by way of example may of course be replaced by equivalent elements, without departing from the scope of the present invention. In particular, the screen 15 may be mounted on any known type of finishing machine.

I claim:

1. A process of making a non-skid highway surface comprising the successive steps of:

making, in a mixing plant, a hot-mixed aggregate containing a variety of aggregate and sand sizes of at least two ranges of grading by melting a bituminous binder, heating aggregate chips and sand and mixing the heated chips and sand and the molten binder, and thereafter spreading onto a highway a layer of the hot mixed aggregate, said spreading step including the steps of screening the hot mixed aggregate through a vibrating screen which is moved along said highway, and which has a mesh size that is larger than the upper limit of the lower grading range and smaller than the upper limit of the higher grading range, depositing the portion of the hot melt aggregate passing through the screen on said highway and depositing the material retained on the screen on top of the portion of the hot mixed aggregate which passed through the screen and was previously deposited on the highway.

2. A process as claimed in claim 1, wherein the mesh of the screen is selected such that the quantity of aggregates retained on the screen and which are deposited on the portion of the hot mixed aggregate passing through the screen, expressed in liters per square meter of highway, is substantially equal to the upper limit of grading of the chips expressed in millimeters.

3. A non-skid highway surfacing made in accordance with the process as claimed in claim 1, comprising a relatively thick carpet of hot-mixed aggregages including two superposed layer of hot-mixed aggregates, of different grading, spread simultaneously by screening the mixed aggregates during spreading, so that the top layer, constituted by the material retained by the screen, is composed of a continuous mosaic of large chips which penetrate into the lower layer.

4. A non-skid highway surfacing as claimed in claim 3, wherein said chips include at least two ranges of grading separated by a discontinuity in their ranges, said ranges of chips including a first range of between 9 mm and 16 mm and a second range of grading lower than 9 mm, which chips are spread out by screening them through a screen whose mesh is smaller than 16 mm.

5. A non-skid highway surfacing as claimed in claim 3, composed of aggregates hot-mixed in molten asphaltic bitumen, in a quantity equal to about 5% of the total weight, which aggregates are composed:

of a first type of chips graded between 9 mm and 16 mm and preferably between 10 mm and 14 mm, constituting between 30% and 50% of the total weight, of a second type of chips graded between 2 mm and 6 mm constituting between 10% and 30% of the total weight, of a sand whose particles are smaller than 4 mm, constituting between 30% and 50% of the total weight, and a filler constituting between 1% and 5% of the total weight, said aggregates being spread out during said spreading step by being screened through a vibrating screen whose mesh is smaller than 16 mm and larger than 6 mm and preferably between 10 mm and 14 mm, so that the top layer which is constituted by the material retained by the screen is composed of a continuous mosaic of chips larger than 14 mm which are mixed with asphaltic bitumen and particles of sand and which pentrate into the lower layer.

6. A surfacing as claimed in claim 5, wherein the sand is graded between 0 and an upper limit which is smaller than 2 mm and presents a discontinuity with the grading of the second chips.

7. A surfacing as claimed in claim 6, wherein the aggregates are composed:

of about 40% of a first type of chips (10–14 mm)
about 20% of a second type of chips (2–6 mm)
about (40% ground quartz sand (0–0.5 mm)
about 2% of lime serving as filler.

8. A process as claimed in claim 1, wherein said step of depositing the portion of the hot mixed aggregate passing through the screen comprises the step of permitting said portion to drop through the screen directly onto the highway.

9. A process as claimed in claim 8 wherein said step of depositing the material retained on the screen comprises the step of dropping said material off the end of the screen opposite the direction of displacement thereof onto the portion of the hot mixed aggregate which had previously dropped through the screen onto the highway.

* * * * *